US007549599B2

(12) United States Patent
Amron

(10) Patent No.: US 7,549,599 B2
(45) Date of Patent: Jun. 23, 2009

(54) DEVICE FOR DISPENSING A VISCOUS FLUID PRODUCT IN A PATTERN

(75) Inventor: Alan Amron, Brooklyn, NY (US)

(73) Assignee: Tropical Ventures, LLC, Hempstead, NY (US)

( * ) Notice: Subject to any disclaimer, the term of this patent is extended or adjusted under 35 U.S.C. 154(b) by 461 days.

(21) Appl. No.: 11/482,868

(22) Filed: Jul. 7, 2006

(65) Prior Publication Data

US 2007/0018015 A1 Jan. 25, 2007

Related U.S. Application Data

(63) Continuation-in-part of application No. 11/339,738, filed on Jan. 25, 2006, which is a continuation-in-part of application No. 11/271,613, filed on Nov. 12, 2005, which is a continuation-in-part of application No. 11/136,693, filed on May 23, 2005, now Pat. No. 7,458,485, said application No. 11/339,738 is a continuation-in-part of application No. 11/237,424, filed on Sep. 28, 2005, which is a continuation-in-part of application No. 11/230,143, filed on Sep. 19, 2005, now Pat. No. 7,374,069.

(51) Int. Cl.
*B05B 3/00* (2006.01)

(52) U.S. Cl. ..... 239/263.2; 239/333; 239/332; 239/225.1; 239/241; 239/263.1; 222/321.9; 222/321.1; 222/321.7; 222/320; 222/384; 222/383.1; 222/383.2

(58) Field of Classification Search ..... 239/332, 239/333, 334, 263.1, 225.1, 227, 232, 241, 239/251, 360, 390, 391, 242, 247, 263.2, 239/263.3, 264, 265; 222/526, 529, 533, 222/372, 381, 383.1, 383.2, 384, 383.3, 400.8, 222/320, 321.1, 321.9, 321.7, 190, 192
See application file for complete search history.

(56) References Cited

U.S. PATENT DOCUMENTS

| | | | |
|---|---|---|---|
| 1,150,940 | A | 8/1915 | Irish |
| 1,798,488 | A | 3/1931 | Fingal |
| 1,941,786 | A | 1/1934 | Carley et al. |
| 2,381,740 | A | 9/1945 | Grelson |
| 2,794,292 | A | 3/1957 | Noble |
| 2,830,739 | A | 4/1958 | Moye |

(Continued)

*Primary Examiner*—Dinh Q Nguyen

*Assistant Examiner*—Trevor E McGraw
(74) *Attorney, Agent, or Firm*—Cohen Pontani Lieberman & Pavane LLP

(57) ABSTRACT

A device for dispensing a viscous fluid product, including a pump having an inlet; an outlet; a cylinder; a piston in the cylinder; and a piston rod attached to the piston with its first end being exposed. The pump pumps viscous fluid product from a container to the outlet when the inlet is submerged in the viscous fluid product and the piston rod is axially moved relative to the cylinder. The device further includes a handle attached to the piston rod; a nozzle rotatably mounted on the handle around a rotation axis, in fluid communication with the outlet, and having a discharge orifice offset from the rotation axis; and a mechanism for rotating the nozzle around the rotation axis when the piston rod is axially moved relative the cylinder so that the discharge orifice moves in a circular pattern for dispensing the viscous liquid product in a substantially helical pattern.

6 Claims, 6 Drawing Sheets

U.S. PATENT DOCUMENTS 2,998,166 A 8/1961 Klawiter
3,399,638 A 9/1968 Bishop et al.
3,493,179 A 2/1970 Hsuen
3,556,689 A 1/1971 Hechler, IV
3,804,336 A 4/1974 Koeppe
4,286,736 A * 9/1981 Corsette ..... 222/153.13
4,335,677 A 6/1982 Nagata
4,397,879 A 8/1983 Wilson
4,542,853 A 9/1985 Diamond
4,615,488 A 10/1986 Sands
4,709,691 A 12/1987 Lemons et al.
4,821,961 A 4/1989 Shook
4,838,490 A * 6/1989 Nissels ..... 239/333
4,842,200 A 6/1989 Hermansson
4,989,786 A 2/1991 Kranzle et al.
5,024,382 A 6/1991 Shook et al.
5,060,863 A 10/1991 Hammelmann
5,086,974 A 2/1992 Henshaw
5,104,043 A 4/1992 Pacht
5,224,652 A 7/1993 Kessler
5,244,153 A 9/1993 Kuhn et al.
5,297,979 A 3/1994 Amron
5,392,968 A 2/1995 Dark
5,395,053 A 3/1995 Frech
5,427,320 A 6/1995 Mak et al.
5,433,646 A 7/1995 Tarng
5,456,413 A 10/1995 Ellis
5,492,275 A * 2/1996 Crampton ..... 239/333
5,505,380 A 4/1996 Jun
5,577,945 A 11/1996 La Belle
5,582,532 A 12/1996 Tucker
5,595,345 A 1/1997 Chura et al.
5,667,138 A * 9/1997 Crampton ..... 239/225.1
5,674,323 A 10/1997 Garcia
5,725,680 A 3/1998 Mathieus
5,740,964 A * 4/1998 Crampton ..... 239/333
5,826,750 A 10/1998 Johnson
5,865,344 A 2/1999 Nagel
5,878,914 A 3/1999 Johnson
6,007,003 A 12/1999 Wang
6,129,293 A 10/2000 Jaeger
6,151,824 A 11/2000 Clayton
6,155,494 A 12/2000 Fabbri
6,186,367 B1 2/2001 Harrold
6,196,475 B1 3/2001 Jaeger
6,199,771 B1 3/2001 Clearman et al.
6,250,506 B1 6/2001 Geiger et al.
6,331,130 B1 12/2001 Thai
6,422,480 B1 7/2002 Richmond
6,474,507 B1 11/2002 Hornsby
RE38,077 E * 4/2003 Cohen et al. ..... 239/333
6,540,108 B1 4/2003 Johnson
6,594,843 B1 7/2003 Wilkins
6,648,244 B2 * 11/2003 Yu ..... 239/323
6,676,037 B2 1/2004 Marks
6,719,218 B2 4/2004 Cool et al.
6,766,967 B2 7/2004 Harris et al.
6,769,631 B2 * 8/2004 Brown ..... 239/289
6,892,902 B2 5/2005 Hornsby
6,899,286 B2 5/2005 Blessing
6,935,531 B1 8/2005 Clayton
6,959,838 B2 11/2005 Eddins et al.
7,032,837 B2 4/2006 Eddins et al.
7,097,073 B2 8/2006 Zimmerman
7,111,795 B2 9/2006 Thong
7,131,557 B2 11/2006 Zimmerman et al.
7,182,477 B1 2/2007 Hartz
7,185,787 B2 3/2007 Brown et al.
2001/0019083 A1 9/2001 Marks
2002/0030066 A1 3/2002 McKenna
2002/0090878 A1 7/2002 Holmes
2003/0071141 A1 4/2003 Rieben
2003/0085303 A1 5/2003 Jaeger
2004/0164090 A1 8/2004 Eddins et al.
2005/0173559 A1 8/2005 Eddins et al.
2006/0065760 A1 3/2006 Micheli
2006/0076435 A1 * 4/2006 Hudson et al. ..... 239/332

* cited by examiner

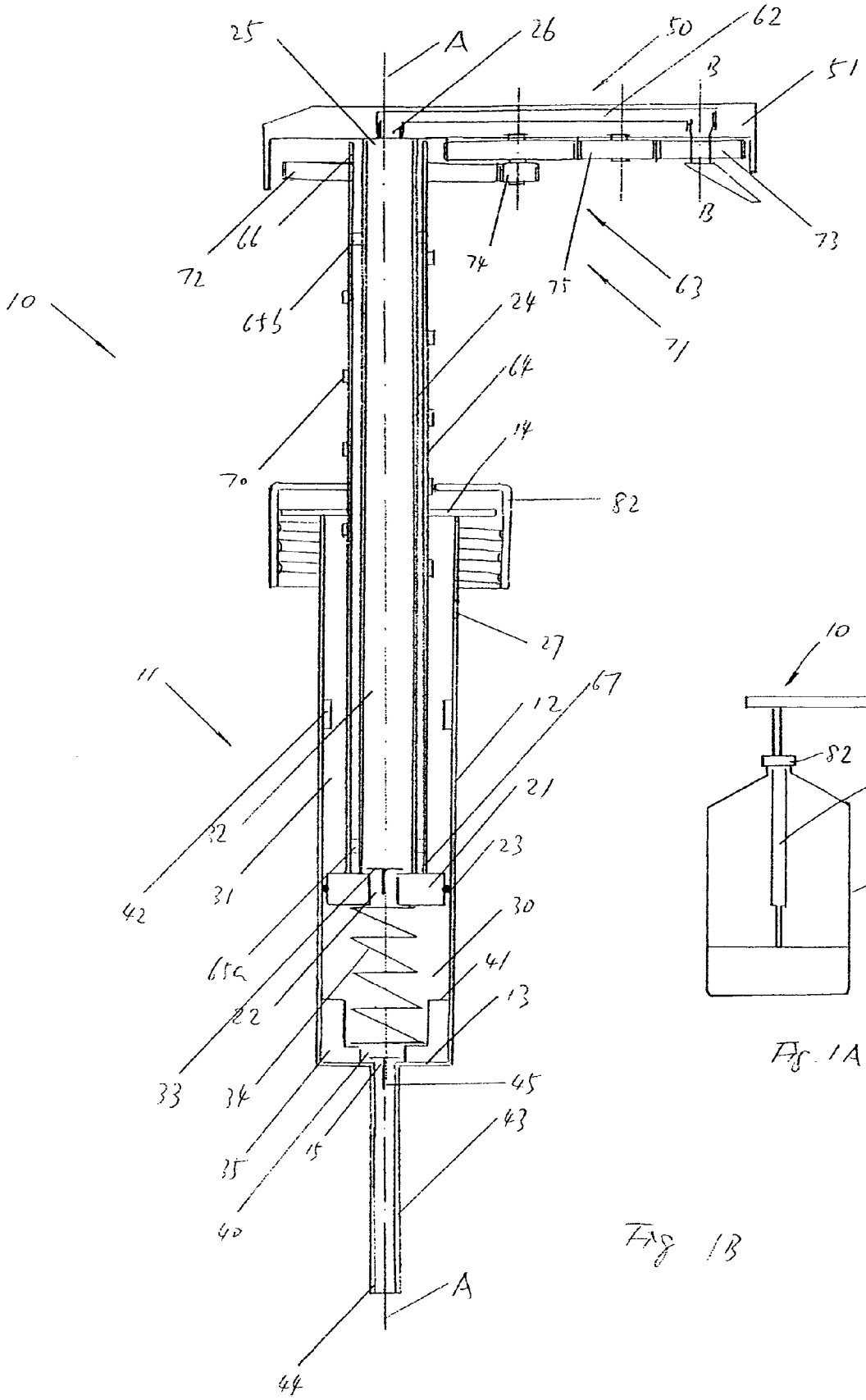
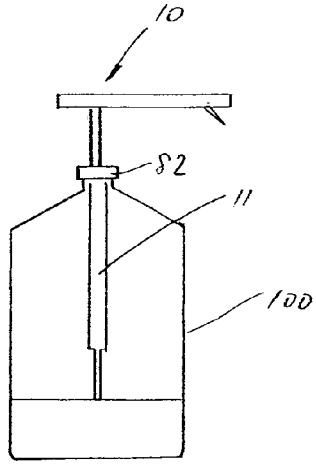
Fig. 1A
Fig 1B

DEVICE FOR DISPENSING A VISCOUS FLUID PRODUCT IN A PATTERN

CROSS-REFERENCE TO RELATED APPLICATIONS

This application is a continuation-in-part of U.S. patent application Ser. No. 11/339,738, filed on Jan. 25, 2006, which is a continuation-in-part of U.S. patent application Ser. No. 11/271,613, filed on Nov. 12, 2005, which is a continuation-in-part of U.S. patent application Ser. No. 11/136,693, filed on May 23, 2005 now U.S. Pat. No. 7,458,485.

U.S. patent application Ser. No. 11/339,738 is also a continuation-in-part of U.S. patent application Ser. No. 11/237,424, filed on Sep. 28, 2005, which is a continuation-in-part of U.S. patent application Ser. No. 11/230,143, filed on Sep. 19, 2005 now U.S. Pat. No. 7,374,069.

The entire content of U.S. patent application Ser. No. 11/339,738 is incorporated herein by reference.

BACKGROUND OF THE INVENTION

1. Field of the Invention

The present invention relates generally to a fluid dispenser. More specifically, the present invention relates to a device for dispensing a viscous fluid food product in a substantially helical pattern.

2. Description of the Related Art

Devices for dispensing viscous fluid products such as, for example, liquid paints, liquid soaps, detergents, cleansers, glues, and condiments such as ketchup, mustard, barbeque sauce, salad dressing, syrup, jelly, and mayonnaise are well known. Such devices are commonly used in high-traffic places such as restaurants, cafeterias, and other commercial food service establishments.

Typically, such a device includes a manually operable pump. The pump usually has an inlet, an outlet, a cylinder, a piston in the cylinder with freedom of axial movement, and a piston rod fixedly attached to the piston and extending through an end surface of the cylinder with an end thereof being disposed outside the cylinder. The piston or the piston rod can be moved between an upper working position and a lower working position. The pump is operable to suck or pump in, via its inlet, a viscous fluid product from a container when the piston or the piston rod is moved in one direction and to dispense or pump out, via its outlet, the viscous fluid product when the piston or the piston rod is moved in the opposite direction. Typically, there is a spring installed inside the cylinder, which loads or biases the piston or the piston rod in the upward direction to ensure that the piston or piston rod will automatically return to its upper working position when there is no exterior force pushing it in the downward direction.

A handle is fixedly attached to the exposed end of the piston rod and has a discharge orifice which is in fluid communication with the outlet of the manually operable pump. The discharge orifice is rotationally fixed relative to the handle and the piston rod.

The device is fixedly mounted on a container through a threaded cap, with the handle being disposed outside the container. There should be a sufficient amount of viscous fluid product in the container so that the inlet of the pump can be submerged in the viscous fluid product. The inlet of the manually operable pump is usually positioned very close to the bottom of the container so that there is no need to frequently add viscous fluid product to the container until the container is almost empty.

When a person needs some viscous fluid product, that person simply pushes the handle to move the piston or the piston rod from its upper working position toward its lower working position, and the pump will pump out the viscous fluid product from the container. If that person needs more viscous fluid product than the device is able to dispense in a single push, he or she can release the handle, and after the piston or the piston rod returns to its upper working position, pushes down the handle again, and if necessary repeat this process until he or she has a sufficient amount of the viscous fluid product.

Since the discharge orifice is rotationally fixed relative to the handle, the device will dispense the viscous fluid product in a continuous straight stream pattern. This pattern may fail to provide adequate coverage of a target area, may place too much of the product in one area, or may simply be too plain.

Thus, a need exists for a dispensing device which, when used in combination with a conventional container, is capable of providing an adequate coverage of a viscous fluid product, on a target area.

A further need exists for a dispensing device which, when used in combination with a conventional container, is capable of dispensing a viscous fluid product in a pattern other than a straight stream.

Yet a further need exists for a simple and manually operable dispensing device which, when used in combination with a conventional container, is capable of dispensing a viscous fluid product in a substantially helical pattern.

SUMMARY OF THE INVENTION

To meet these and other needs, the present application discloses a device for dispensing a viscous fluid product from a container. The device includes a pump which has an inlet and an outlet and comprises a cylinder, a piston in the cylinder with freedom of axial movement, and a piston rod attached to the piston with a first end thereof being disposed outside the cylinder. The pump is operable to pump the viscous fluid product from the container to the outlet when the inlet is submerged in the viscous fluid product and the piston rod is axially moved relative to the cylinder.

The device further includes a handle attached to the first end of the piston rod, and a nozzle rotatably mounted on the handle around an axis of rotation. The nozzle is in fluid communication with the outlet of the pump, and has a discharge orifice radially offset from the axis of rotation. The device further includes a mechanism for rotating the nozzle around the axis of rotation when the piston rod is axially moved relative the cylinder so that the discharge orifice moves in a circular pattern for dispensing the viscous liquid product in a substantially helical pattern when the viscous liquid product flows through the discharge orifice.

Other features and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

FIG. 1A shows schematically an exemplary device for dispensing a viscous fluid food product from a container in accordance with the present invention;

FIG. 1B is an enlarged, partially cross sectional view of the exemplary device of FIG. 1A;

DETAILED DESCRIPTION OF THE PRESENTLY PREFERRED EMBODIMENTS

Embodiments of nozzle translation assemblies are described below and depicted on a food dispensing container with a specific example of a viscous fluid food dispensing pump. The particular description is an example only and is not meant restrict the scope of the invention in any way.

With regard to the manner in which the viscous fluid food product is urged to flow toward a discharge orifice upon depression of a trigger or other means, it should be borne in mind that although the various embodiments described herein incorporate a pump for withdrawing the fluid food product from a container and then pumping the withdrawn fluid food product, the invention is not limited to such configurations. For example, a motorized arrangement may be used. The pump may alternatively pressurize the container to force the food product out through the nozzle. By way of further example, the food product storing chamber may be configured as a bag or expandable bladder dimensioned and arranged to receive and store the food product. It suffices to say that the manner in which food product ejection forces are developed is of no particular consequence to the inventor herein except insofar as manufacturing cost, simplicity and ease of use are always considerations to be borne in mind.

Referring now to FIG. 1A, an exemplary embodiment of a device 10 for dispensing a viscous fluid product in accordance with the present invention is shown mounted on a container 100. The device 10 includes a manually operable pump 11, which operates in the manner of a conventional pump for dispensing a flowable condiment such as ketchup. An exemplary embodiment of the pump 11 is discussed below.

Figure 2:
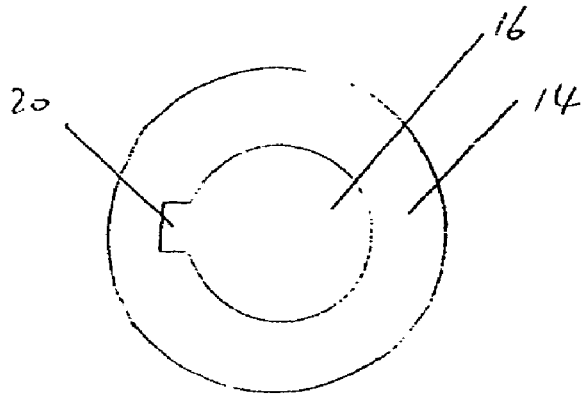
FIG. 2 is a top plane view of an end surface of a cylinder of the exemplary device of FIG. 1B.

Referring now to FIG. 1B, the pump 11 includes a cylinder 12 having a longitudinal axis A-A, a first end surface 13 which has a substantially central opening 15, and a second end surface 14 which is opposite to the first end surface 13. The second end surface 14 preferably has an outer diameter which is greater than that of the cylinder 12. In addition, as best illustrated in FIG. 2, the second end surface 14 has a substantially central opening 16. A notch 20 is formed on the periphery of the opening 16. The functions of the openings 15 and 16 and the notch 20 will be discussed below.

As shown in FIG. 1B, the pump 11 further includes a piston 21 in the cylinder 12 with freedom of axial movement between a first working position which is closer to the first end surface 13 of the cylinder 12 and a second working position which is closer to the second end surface 14. The piston 21 preferably has a substantially central through passage 22. A seal 23 such as, for example, an O-ring seal, is provided between the piston 21 and the cylinder 12. Although an O-ring seal is discussed in the exemplary embodiment of FIG. 1B, any known or hereafter developed seal may be used, including a direct seal between the piston 12 and the cylinder 12.

A hollow piston rod 24 is fixed attached to the piston 21 and extends through the second end surface 14 of the cylinder via the opening 16. Thus, one end 25 of the piston rod 24 is disposed outside the cylinder 12. The exposed end 25 has an outlet 26 which constitutes an outlet for the pump 11. Preferably, the hollow piston rod 24 and the piston 21 are rotationally fixed relative to the cylinder 12. As clearly shown in FIG. 1B, the piston 21 divides the interior of the cylinder 12 into a first working space 30 which is away from the hollow piston rod 24, and a second working space 31 which is around the hollow piston rod 24. The hollow piston rod 24 itself defines a third working space 32 in its interior.

The cylinder 21 preferably has a pressure releasing opening 27 near the second end surface 14, which opening connects the second working space 31 with the outside of the cylinder 12 and is operable to release or reduce the pressure in the second working space 31 when the piston 21 is moved in a direction from the first working position toward the second working position.

The through passage 22 of the piston 21 constitutes a fluid connection which connects the first working space 30 and the third working space 32 with each other. A non-return or one-way valve 33 is provided in the fluid connection and is preferably mounted around the top periphery edge of the through passage 22 so that fluid can flow into, but cannot flow out of the third working space 32 through the through passage 22.

Preferably, the piston 21 is biased or loaded toward its second working position by a spring 34 provided in the first working space 30. A spring seat 35 is preferably installed inside the first working space 30 and against the first end surface 14 to hold the spring 34 in place. The spring seat 35 has a substantially central opening 40 which is in fluid communication with the opening 15 of the first end surface 13, and a generally annular upper edge 41 which limits the axial movement of the piston 21 toward the first end surface 13. Thus, when the piston 21 is stopped by the upper edge 41 of the spring seat 35, it reaches its first working position. In FIG. 1B, the piston 21 is shown in a position between its first and second working positions. Preferably, a stopper 42 is also provided in the second working space 31 and attached to the cylinder 12 for limiting the axial movement of the piston 21 toward the second end surface 14. The stopper 42 defines the second working position of the piston 21.

An inlet hose or tube 43 is attached to the first end surface 13 and extends outward therefrom. The inlet hose 43 covers and is in fluid communication with the opening 15 of the first end surface 13. In addition, the inlet hose 43 has a distal end 44 which is remote from the opening 15, and constitutes an inlet for the pump 11. The inlet hose 43 and the openings 15 and 40 constitute another fluid connection which connects the first working space 30 with the outside of the cylinder 12. A non-return or one-way valve 45 is provided in this fluid connection and is preferably mounted around the periphery of the opening 15 so that fluid can flow in, but cannot flow out of the first working space 30 through this fluid connection.

The device 10 also includes a substantially elongated handle 50, which is fixed mounted on the exposed end 25 of the hollow piston rod 24. The handle 50 has a support member 50*a*, and a distal end 51 which is remote from the hollow piston rod 24.

Figure 3:
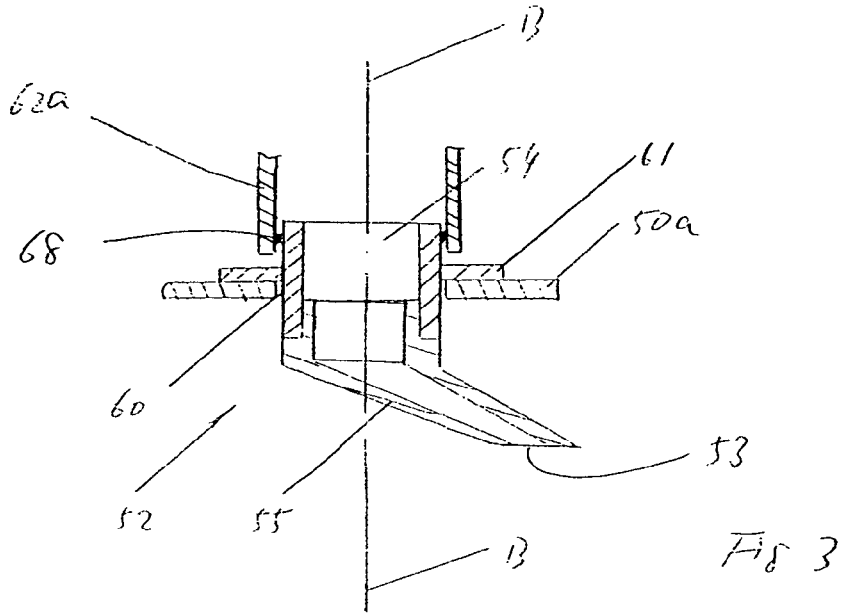
FIG. 3 is a cross sectional view of a nozzle of the exemplary device of FIG. 1B; the nozzle is shown in FIG. 3 without any gear of a driving mechanism attached to it.

The device 10 also includes a nozzle 52 which has a discharge orifice 53. The nozzle 52 is rotatably mounted on the distal end 51 of the handle 50 around an axis of rotation B-B. More specifically, as shown in FIG. 3, the nozzle 52 has a hollow shaft portion 54 which passes through a corresponding hole 60 in the support member 50*a* of the handle 50 and is held in place by a flange 61. The nozzle 52 also has a hollow head portion 55 which is preferably releasably attached to the hollow shaft portion 54 by a snap-fit connection. The discharge orifice 53 is formed in the hollow head portion 55 and is radially outset from the axis of rotation B-B. The nozzle 52 is in fluid communication with the outlet 26 and the third working space 32 via yet another fluid connection 62 preferably in the form of a hose. More particularly, as shown in FIG. 3, the nozzle 52 can be rotatably connected to the outer end 62*a* of the hose 62 by a sealed bearing 68. In this arrangement, at least the outer end 62*a* of the hose 62 is fixed relative to the handle 50. Alternatively, the nozzle 52 can be fixedly connected to the outer end 62*a* of the hose 62 by a connector such as, for example, a clamp.

Moreover, the device 10 includes a mechanism 63 for rotating the nozzle 52 around the axis of rotation B-B when the piston 21 is moved in a direction from the second working position toward the first working position. This rotating mechanism 63 includes a sleeve 64 which preferably concentrically surrounds the hollow piston rod 24 by means of two circular spacers 65*a* and 65*b*, and passes through the opening 16 of the second end surface 14 of the cylinder 12. The sleeve 64 has a first end 66 which is adjacent to the exposed end 25 of the hollow piston rod 24, and a second end 67 which is adjacent to the piston 21. Thus, the sleeve 64 can rotate relative to the hollow piston rod 24, but it cannot move substantially in the axial direction relative to the hollow piston rod 24. The sleeve 64 also has an exterior helical rib 70 which extends downward from a first point adjacent to the first end 66 to a second point on the sleeve 64. The second point does not need to be every close to the piston 21, but it should be deep enough so that it is still inside the second working space 31 when the piston 21 is in the second working position.

In the exemplary embodiment, the second end surface 14 of the cylinder 12 also constitutes a guiding member with its notch 20 engaging the exterior helical rib 70. Thus, when the piston 21 is moved in a direction from the second working position toward the first working position, the guiding member causes or forces the sleeve 64 to rotate relative to the hollow piston rod 24.

This rotating mechanism 63 also includes a driving mechanism 71 for using the rotational movement of the sleeve 64 relative to the hollow piston rod 24 to rotate the nozzle 52 around the axis of rotation B-B. In the exemplary embodiment, the driving mechanism 71 is a gear train which includes an inter gear 72 which is fixedly mounted on the sleeve 64 and adjacent to the first end 66 of the sleeve 64, and an outer gear 73 which is fixedly mounted on the hollow shaft portion 54 of the nozzle 52 and is in driving relationship with the inner gear 72 by means of two intermediate gears 74 and 75.

Figure 4:
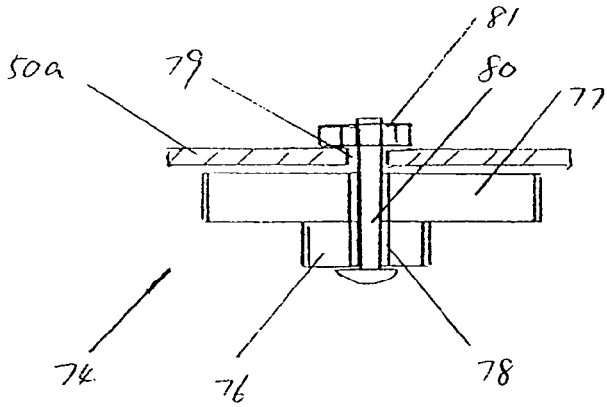
FIG. 4 is a cross sectional view of an intermediate gear of a driving mechanism of the exemplary device of FIG. 1B.

As shown in FIGS. 1B and 4, the intermediate gear 74 preferably has a first gear portion 76, a second gear portion 77 which is fixedly and concentrically attached to the first gear portion 76, and a substantially central through hole 78. The intermediate gear 74 is rotatably mounted on the handle 50 by a bolt 80 which passes through the through hole 78 and a corresponding hole 79 on the support member 50*a* of the handle 50 and by a nut 81 which threadedly engages the bolt 80. As shown in FIG. 1B, the second gear portion 77, which has an outer diameter which is much smaller than that of the first gear portion 76, meshes with the inner gear 72.

In a similar fashion, the intermediate gear 75 is rotatably mounted on the handle 50. As shown in FIG. 1B, the intermediate gear 75 meshes with the first gear portion 76 of the intermediate gear 74 and the outer gear 73. Although the exemplary embodiment of FIG. 1B includes two intermediate gears, any number of intermediate gears may be used. Alternatively, the outer gear 73 may directly meshes with the inner gear 72, without using any intermediate gear.

Figure 5:
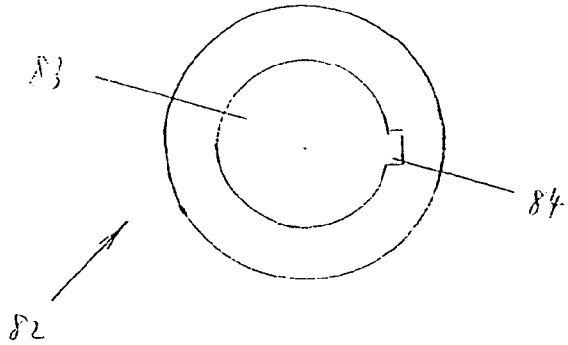
FIG. 5 is a top plane view of an threaded cap of the exemplary device of FIG. 1B.

Referring to FIGS. 1B and 5, the device 10 preferably includes a threaded cap 82, which is operable to releasably mount the device 10 on a container having a threaded top. Similar to the second end surface 14 of the cylinder 12, the threaded cap 82 has a substantially central opening 83 shaped to receive the sleeve 64, and a notch 84 formed on the periphery of the opening 83 for engaging the exterior helical rib 70 of the sleeve 64. As shown in FIG. 1B, the threaded cap 82 is sized to receive the second end surface 14 of the cylinder 12. In other embodiments (to be discussed below) where the sleeve 64 is omitted, the threaded cap 82 does not need the notch 84, and its opening 83 is shaped to receive the cylinder 12 instead. Furthermore, the threaded cap 82 is fixedly mounted on the cylinder 12.

One can securely and releasably mount the device 10 on the container 100 by threadedly advancing the threaded cap 82 on the threaded top until the second end surface 14 is firmly against the threaded cap 82. At this point, the threaded cap 82 also functions as a guiding member for the exterior helical rib 70. In addition, the openings 16 and 83 are such that air can flow into the second working space 31 from the outside. With the exception of the notch 84, the threaded cap 82 is substantially similar to caps used in the prior art devices, and therefore its function and operation will not be discussed in greater detail here.

During operation, the device 10 is fixedly mounted on the container 100 with the cylinder 12 being disposed inside, and the handle 50 being disposed outside of the container 100. The distal end 44 of the inlet hose 43 is submerged in viscous fluid product in the container 100, and is preferably disposed very close to the bottom of the container. The pump 11 is operable to pump the viscous fluid product from the container 100 to the first working space 30 when the piston 21 is moved in a direction from the first working position toward the second working position, and to pump the viscous fluid product from the first working space 30 to the third working space 32 when a user overcomes the biasing force of the spring 34 by pushing the handle 50 downward to move the piston 21 in a direction from the second working position toward the first working position. Because of the spring 34, the piston 21 is normally in the second working position. If a user pushes the piston 21 toward the first working position, the piston 21 will automatically return to the second working position after the user releases the handle 50.

When a user desires to dispense the viscous fluid product, the user simply pushes the handle 50 downward to move the piston 21 in a direction from the second working position toward the first working position. During the process, any viscous fluid product already existing in the first working space 30 is pumped into the third working space 32 through the passage 22, which in turn forces any viscous fluid product already in the third working space 32 to be moved toward and eventually dispensed from the discharge orifice 53 of the nozzle 52. The operating principle of the pump 11 is well known in the art, and therefore will not be discussed in more detail here.

Pushing the handle 50 downward also causes the sleeve 64 and the hollow piston rod 24 to move axially into the cylinder 12. The notches 20 and 84 are rotationally fixed relative to the cylinder 12, and engage the exterior helical rib 70 of the sleeve 64. As a result, axial movement of the sleeve 64 relative to the cylinder 12 causes the sleeve 64 as well as the inner gear 72 to rotate relative to the hollow piston rod 24 about the longitudinal axis A-A. Rotation of the inner gear 72 in turn causes the outer gear 73 as well as the nozzle 52 to rotate because of the intermediate gears 74 and 75. As discussed earlier, the discharge orifice 53 of the nozzle 52 is radially offset from the axis of rotation B-B. The end result is that the discharge orifice 53 moves in a circular pattern when it dispenses the viscous fluid product, resulting in dispensing the viscous fluid product in a substantially helical pattern.

Figure 6:
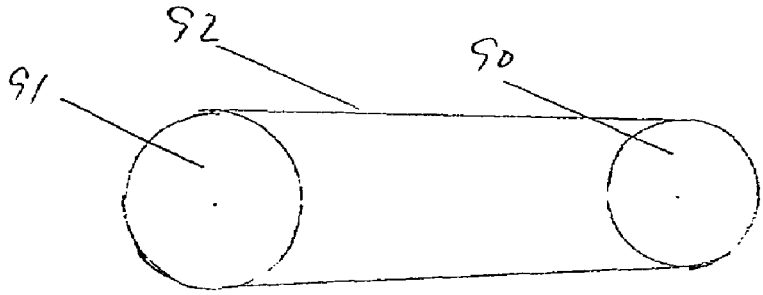
FIG. 6 shows a variance of the driving mechanism of the exemplary device of FIG. 1B.
Figure 7:
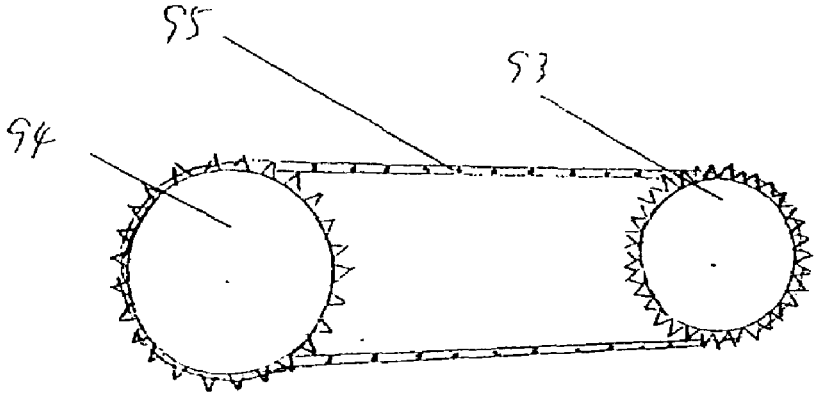
FIG. 7 shows another variance of the driving mechanism of the exemplary device of FIG. 1B.

Various modifications can be made to the exemplary device 10. For example, instead of using a gear mechanism as discussed above, the driving mechanism 71 can be in the form of an outer pulley 90 fixedly mounted on the nozzle 52, an inner pulley 91 fixedly mounted on the sleeve 64, and an endless drive belt 92 (see FIG. 6), or in the form of an outer chain wheel 93 fixedly mounted on the nozzle 52, an inner chain wheel 94 fixedly mounted on the sleeve 64, and an endless drive chain 95 (see FIG. 7).

Figure 8:
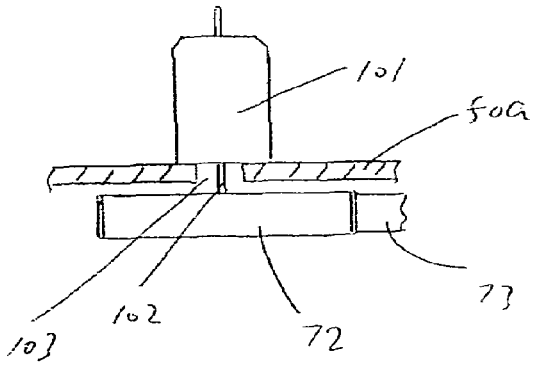
FIG. 8 is a cross sectional view of a variance of the rotating mechanism of FIG. 1B, which is used in another exemplary device in accordance with the present invention.

Alternatively, the rotating mechanism 63 may include an electric motor 101 which preferably is borne by the handle 50 and in driving relationship with the nozzle 52. More particularly, as shown in FIG. 8, the electric motor 101 may be fixedly attached to the support member 50*a* with its drive shaft 102 passing through a hole 103 of the support member 50*a* and being fixedly connected to the inner gear 72. The inner gear 72, which replaces the intermediate gear 75 shown in FIG. 1, directly meshes with the outer gear 73. The electric motor 101 is preferably automatically actuated—for example in response to a pressure caused by operation of the pump—and is operable to rotate the nozzle 52 about the axis of rotation B-B when a user pushes the handle 50 downward to move the piston 21 in a direction from the second working position toward the first working position. In this arrangement, the sleeve 64, the guiding member, and the intermediate gears 74 and 75 may be omitted. The electric motor may also be manually operated. For example, a user may switch on the pump when the user desires to dispense the food product.

Figure 9:
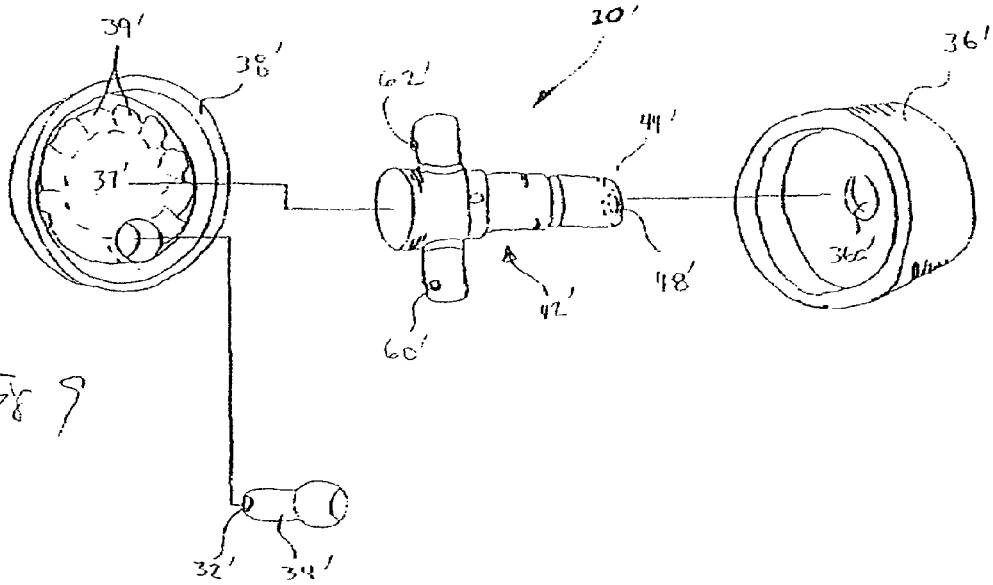
FIG. 9 is a broken apart, perspective view depicting the internal construction of an exemplary nozzle translation assembly used in yet another exemplary device in accordance with the present invention.
Figure 10:
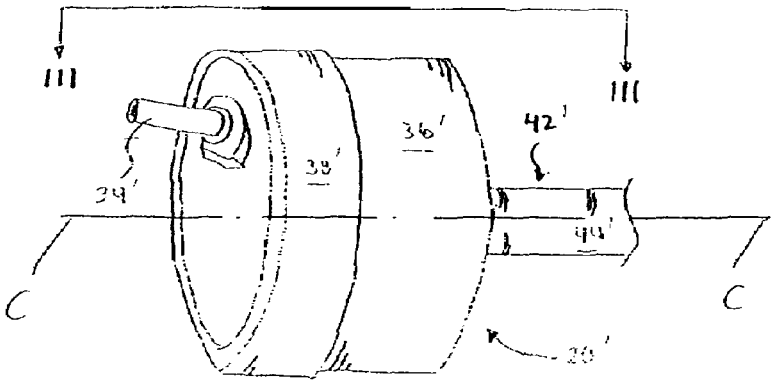
FIG. 10 is a perspective view depicting final assembly of the nozzle translation assembly of FIG. 9.
Figure 11:
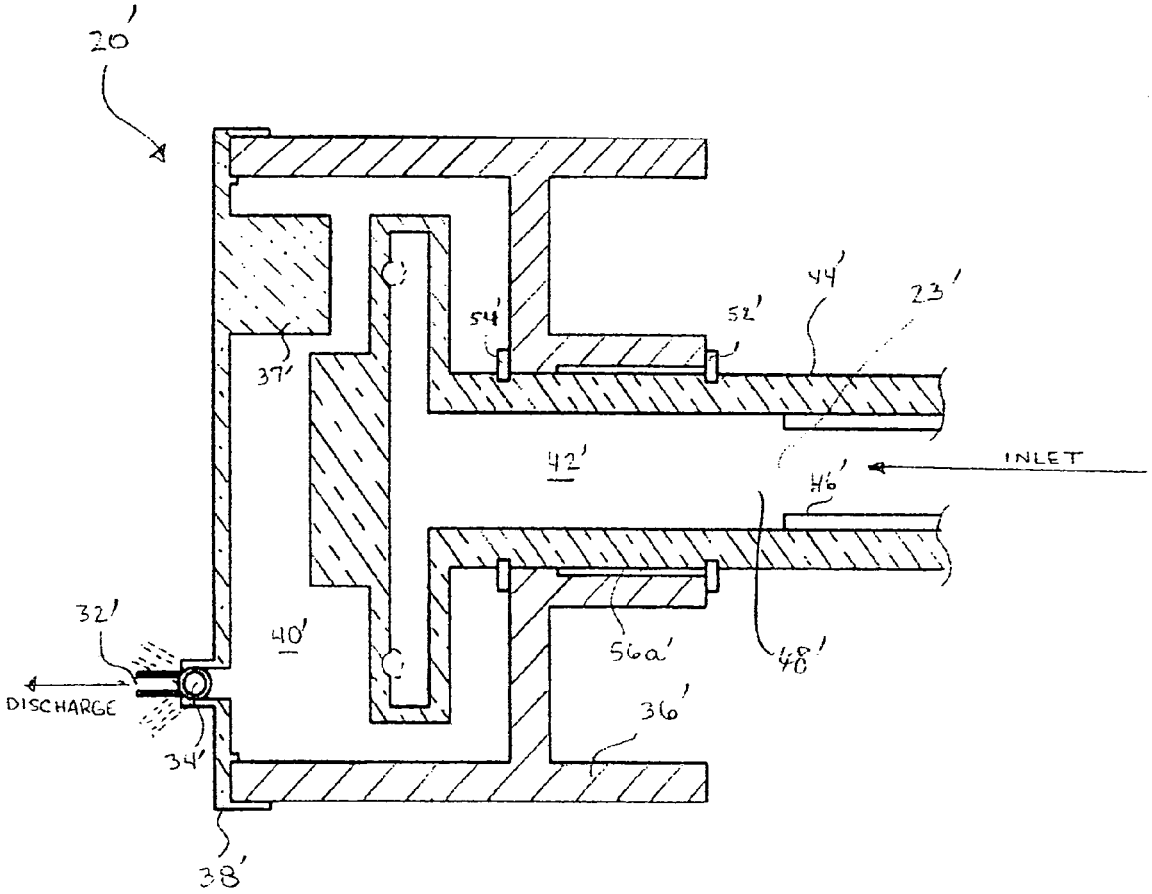
FIG. 11 is a cross sectional view of the nozzle translation assembly of FIGS. 9 and 10, taken across the plane XI-XI depicted in FIG. 10.

Instead of the rotating mechanism 63 and the nozzle 52, the nozzle translation assembly 20' in FIGS. 9-11 may be used. The nozzle translation assembly 20' is substantially as disclosed in U.S. patent application Ser. No. 11/339,738, which is expressly incorporated herein by reference. In this arrangement, at least the proximal end 44' of the flow diverter assembly 42' is fixedly attached to the handle 50, and the second bushing is omitted. The distal end 46' of the conduit disclosed in application Ser. No. 11/339,738 corresponds to the outer end 62*a* of the hose 60 of FIG. 3 of the present application. In accordance with an exemplary embodiment, the force for spinning nozzle translation assembly 20' is provided via the viscous fluid product entering an inlet of the nozzle translation assembly 20'. An exemplary structure adapted to utilize this force is depicted in FIGS. 9-11 and will now be described in detail. As seen in FIG. 9, the nozzle translation assembly 20' comprises a first section 36' and a second section 38' which, when assembled into the configuration shown in FIGS. 10 and 11, define an interior cavity 40' (FIG. 11) within which is disposed a flow diverter assembly indicated generally at 42'.

With reference to both FIGS. 9 and 11, it will be seen that flow diverter assembly 42' has a proximal end 44' dimensioned and arranged to receive and retain the distal end 46' of a conduit. The conduit and flow diverter assembly 42' are fastened together in a conventional manner such, for example, as by a suitable adhesive. As such, the fluid diverter assembly 42' is not a moving part but, rather, is stationary despite being disposed within interior cavity 40'. Viscous fluid product exiting the discharge orifice 23' of conduit enters an inlet 48' defined at the proximal end 44' of flow diverter assembly 42'. The center of the first section 36' defines an axial opening through which the proximal end 44' is inserted. Locking rings indicated generally at 52' and 54' in FIG. 11 prevent axial movement of the diverter assembly 42' relative to the first section 38'. A first bushing indicated generally at 56*a'* enables the first section 36' to rotate about a central axis C-C defined by flow diverter assembly 42'. To prevent water from leaking out of interior cavity 40', O-rings or other suitable gaskets may be utilized at the interface between the interior surface of bore 36*a'* of the first section 36' and the exterior surface of the diverter assembly 42'.

Defined within the interior axial surface 37' of the second section 38' are a plurality of vanes 39'. As best seen in FIG. 9, viscous fluid product entering the inlet 48' of the flow diverter assembly 42' exits via a pair of exit openings indicated generally at 60' and 62'. As will be readily appreciated by those skilled in the art, the exit opening 60' and 62' are dimensioned and arranged so as to cause corresponding jets of viscous fluid product to impinge upon the surfaces of the vanes 39', thereby initiating rotation of the first section 36' and the second section 38'.

In the illustrative embodiment depicted in FIGS. 9-11, it will be seen that the viscous fluid product exits the spinning nozzle translation assembly 20' via a pivotably movable nozzle member 34'. Such a structure is advantageous in that it gives the user a high degree of flexibility in defining the diameter and/or pitch of the helical stream which is discharged. Of course, if such flexibility is not a design constraint, then it is of course possible to integrally form a nozzle member directly as part of the second section 38'. In that regard, it is contemplated that a nozzle member so constructed may be configured to extend forward at any desired angle relative to the axis of rotation of rotatable nozzle translation assembly 20'. It is further contemplated that multiple nozzle members may be included so as to cause to simultaneous streams to be helically wound about the axis of nozzle translation assembly rotation.

As an alternative embodiment, the nozzle translation assembly 20' of FIGS. 9-11 may be made without the vanes 39'. The viscous fluid product exiting through the discharge orifice 32' exerts a thrust on the nozzle member 34' similar to the thrust exerted on a garden hose when water flows through the nozzle. If the discharge canal is arranged at a circumferential angle relative to a plane orthogonal to the axis of rotation, this thrust causes the first section 36' and the second section 38' of the nozzle translation assembly 20' to rotate. According to this alternative embodiment, the rotation of the first and second sections 36', 38' is caused solely by the thrust created at the discharge orifice 32' of the nozzle member 34'.

Figure 12A:
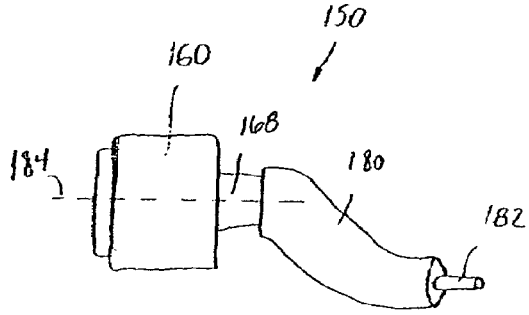
FIGS. 12A-12C are side, front, and longitudinal sectional views of a further embodiment of a nozzle translation assembly according to an embodiment of the present invention.
Figure 12B:
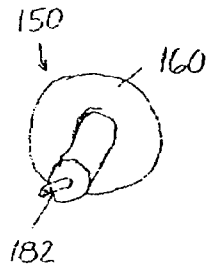
Figure 12C:
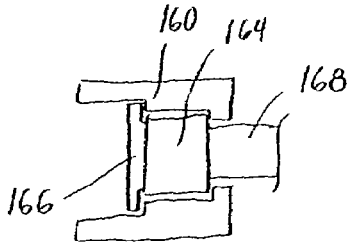

FIGS. 12A-12C disclose a further embodiment of a nozzle translation assembly 150 having a connector housing 160 connectable to a source of pressurized flowable liquid. In this case, the source of the pressurized fluid is the outer end 62*a* of hose 60. In this embodiment, the hose may be non-flexible or flexible. The connection of the nozzle translation assembly 150 may be a friction fit, a threaded connection, or a snap-fit connection between the connector housing 160 and the hose 60.

As shown in FIGS. 12A-12C, a bearing 164 is mounted inside the housing 160 and includes a bearing input part 166 fixed with respect to the housing 160 and bearing output part 168 rotatable relative to the housing 160 via the bearing 164 about an axis of rotation 184. In some cases, the bearing input part 166 will not be required and the bearing can be mounted directly in the housing 160. The bearing 164 preferably comprises a sealed ball bearing assembly. However, any radial bearing which is sealed from or not affected by the flowing fluid may also be used. A discharge tube 180 having a discharge orifice 182 is connected to the bearing output part 168. Accordingly, the discharge tube 180 and discharge orifice 182 rotate about the axis of rotation 184. The discharge orifice 182 is radially offset from the axis of rotation 184 and is also angled so that a nozzle reaction force (thrust) which is created by a stream of fluid discharged from the discharge orifice 182 spins or rotates the discharge tube 180 about the axis of rotation 184, thereby creating a helical output stream. The angle of the discharge orifice 182 also determines how far the stream of food product spreads radially. If the product spreads too far so that the target is missed. Accordingly, both the radial angle relative to the axis of rotation and the circumferential angle relative to a plane orthogonal to the axis of rotation determine the helical shape. A further factor which affects the nozzle reaction force (thrust) and the path of the stream is the diameter of the discharge orifice. Thus, both the angle of discharge and the orifice size must be adjusted according to the viscosity of the fluid food product being dispensed to obtain the optimal dispensing pattern.

Furthermore, the upper end of the cylinder 12, which is adjacent to the second end surface 14, can have a diminished diameter, and the diameter of the second end surface 14 can be reduced to that of the upper end of the cylinder 12. As a result, the cylinder 12 has a neck portion, which receives the threaded cap 82 and is disposed outside of the container when the device is mounted on the container. Alternatively, the second end surface 14 and the threaded cap 82 can be merged into a single element.

Moreover, the sleeve 64 needs not to have a length which is substantially equal to that of the hollow piston rod 24. It only needs a length so that its second end 67 is disposed in the second working space 31 when the piston 21 is in its second working position. A stopper can be installed on the exterior surface of the hollow piston rod 24 so that the sleeve 64 cannot have any meaningful axial movement relative to the hollow piston rod 24.

Furthermore, with regard to fastening, mounting, attaching or connecting components of the present invention to form the device as a whole, unless specifically described otherwise, such are intended to encompass conventional fasteners such as screws, nut and bolt connectors, threaded connectors, snap rings, detent arrangements, clamps such as screw clamps and the like, rivets, toggles, pins and the like. In addition, unless specifically otherwise disclosed or taught, materials for making components of the present invention may be selected from appropriate materials such as metal, metallic alloys, natural and man-made fibers, vinyls, plastics and the like, and appropriate manufacturing or production methods including casting, pressing, extruding, molding and machining may be used.

Thus, while there have shown and described and pointed out fundamental novel features of the present invention as applied to a preferred embodiment thereof, it will be understood that various omissions and other substitutions and modifications/changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A device for dispensing a viscous fluid product from a standing container, the device comprising:

a pump connectable to the container and comprising:

a cylinder having a first end surface and a second end surface which is opposite to the first end surface;

a piston disposed in the cylinder with freedom of axial movement between a first working position and a second working position;

a hollow piston rod fixedly attached to the piston and extending through the second end surface of the cylinder with a first end thereof being disposed outside the cylinder, wherein the piston dividing the cylinder into a first working space on a side of the piston facing away from the piston rod and a second working space on a side of the piston facing the piston rod, and the hollow piston rod defines a third working space therein;

a first fluid connection for connecting the first working space with an inlet leading outside of the cylinder;

a first non-return valve in the first fluid connection;

a second fluid connection which connects the first working space with the third working space; and a second non-return valve in the second fluid connection, wherein the pump is operable to pump the viscous fluid product from the container to the first working space when the inlet of the first fluid connection is submerged in the viscous fluid product and the piston is moved in a first direction from the first working position toward the second working position, and to pump the viscous fluid product from the first working space to the third working space when the piston is moved in a second direction from the second working position toward the first working position;

a handle fixedly attached to the first end of the hollow piston rod facilitating manual operation of the pump;

a nozzle rotatably mounted on the handle around an axis of rotation, the nozzle having a discharge orifice which is radially outset from the axis of rotation;

a third fluid connection which connects the third working space with the nozzle; and a rotating mechanism for rotating the nozzle around the axis of rotation when the piston is moved in the second direction so that the discharge orifice moves in a circular pattern for dispensing the viscous liquid product in a substantially helical pattern when the viscous liquid product flows through the discharge orifice.

2. The device of claim 1, wherein the rotating mechanism comprises:

a sleeve rotatably surrounding the hollow piston rod and comprising an exterior helical rib;

a guiding member rotationally fixed relative to the hollow piston rod and having a notch for engaging the exterior helical rib of the sleeve such that the sleeve rotates relative to the piston rod where the piston is moved in the second direction; and a driving mechanism for rotating the nozzle around the axis of rotation in response to rotation of the sleeve, wherein the discharge orifice faces at least partially downward when the device is connected to the container.

3. The device of claim 2, wherein the driving mechanism comprises an outer gear fixedly mounted on the nozzle, and an inner gear fixedly mounted on the sleeve and in driving relationship with the outer gear.

4. The device of claim 2, wherein the driving mechanism comprises an outer pulley fixedly mounted on the nozzle, an inner pulley fixedly mounted on the sleeve, and an endless drive belt engaging the outer pulley and the inner pulley.

5. The device of claim 2, wherein the driving mechanism comprises an outer chain wheel fixedly mounted on the nozzle, an inner chain wheel fixedly mounted on the sleeve, and an endless drive chain engaging the outer chain wheel and the inner chain wheel.

6. The device of claim 1, wherein the rotating mechanism comprises an outer gear mounted on the nozzle, an electric motor mounted on the handle and having a shaft, and an inner gear connected to the shaft of the electric motor and meshing with the outer gear.

* * * * *